United States Patent [19]

Aoki et al.

[11] Patent Number: 4,922,238

[45] Date of Patent: May 1, 1990

[54] METHOD AND SYSTEM FOR SMOOTH SCROLLING OF A DISPLAYED IMAGE ON A DISPLAY SCREEN

[75] Inventors: Takaaki Aoki; Hiroyasu Iida, both of Ebina; Katsuyuki Nojima, Yokohama, all of Japan

[73] Assignee: International Business Machines Corporation, Armonk, N.Y.

[21] Appl. No.: 143,309

[22] Filed: Jan. 7, 1988

Related U.S. Application Data

[63] Continuation of Ser. No. 868,928, May 29, 1986, abandoned.

[30] Foreign Application Priority Data

May 30, 1985 [JP] Japan ..... 60-115503

[51] Int. Cl.[5] ..... G09G 1/16

[52] U.S. Cl. ..... 340/726; 340/724; 340/728

[58] Field of Search ..... 340/724, 728, 726, 750, 340/721, 723, 716, 799; 364/521

[56] References Cited

U.S. PATENT DOCUMENTS

| | | | |
|---|---|---|---|
| 4,197,590 | 4/1980 | Sukonick et al. | 340/726 |
| 4,386,410 | 5/1983 | Pandya et al. | 340/716 |
| 4,404,554 | 9/1983 | Tweedy, Jr. et al. | 340/750 |
| 4,434,472 | 2/1984 | Kachun | 340/799 |
| 4,437,093 | 3/1984 | Bradley | 340/724 |
| 4,489,317 | 12/1984 | Shiga | 340/726 |
| 4,611,202 | 9/1986 | DiNitto et al. | 340/724 |
| 4,663,617 | 5/1987 | Stockwell | 340/724 |

FOREIGN PATENT DOCUMENTS

| | | |
|---|---|---|
| 50-66445 | 11/1976 | Japan . |
| 57-43991 | 3/1982 | Japan . |
| 57-65644 | 10/1983 | Japan . |
| 57-65645 | 10/1983 | Japan . |

*Primary Examiner*—Gerald Brigance
*Assistant Examiner*—M. Fatahiyar
*Attorney, Agent, or Firm*—Marc D. Schechter

[57] ABSTRACT

A method and apparatus for independently and dynamically performing smooth-scrolling a display line at a time is disclosed herein. An offset value for smooth-scrolling for each display line, is provided which shifts the image information of each display line by pixel. Rewriting of the screen according to the offset value is performed in synchronization with refreshing of the display screen. Selective smooth-scrolling can be performed for a displayed image in each display line, and complicated and various image display can be shifted by controlling the existence or nonexistence and speed of smooth-scrolling for each display line.

8 Claims, 3 Drawing Sheets

METHOD AND SYSTEM FOR SMOOTH SCROLLING OF A DISPLAYED IMAGE ON A DISPLAY SCREEN

This is a continuation of application Ser. No. 868,928, filed on May 29, 1986, now abandoned.

BACKGROUND OF THE INVENTION

A. Field of the Invention

This invention relates to the smooth-scrolling or scrolling by one pixel at a time of a display screen comprising a plurality of display lines, and more particularly the invention relates to performing the smooth-scrolling for each display line.

B. Description of Related Art

As disclosed in Japanese Patent Laid-open Nos. 160984/83, 182690/83, 182691/83 and Japan Patent Publication No. 36779/83, the scrolling of a displayed image on a display screen has been principally attained by shift-controlling the pixels of the image of an entire display screen or by shift controlling the pixels of a representative character or a display block. However, these conventional scrolling techniques of the prior art have not been able to smooth scroll line by line of the displayed image independently, selectively and dynamically.

It is therefore an object of the present invention to provide a method and apparatus for performing selective and dynamic smooth scrolling of a displayed image line by line.

SUMMARY OF THE INVENTION

A method and apparatus for the smooth scrolling of a displayed image on a display screen is disclosed herein. For each individual display line, an offset is provided whereby the image information in each display line is shifted by a number of pixels according to said offset value. The offset value is rewritten in synchronization with the refreshing of the display screen to enhance the perception of the smooth scrolling.

With the method of the subject invention, an offset value for each display line is stored in a storage means. For each of the display lines, when an image is supplied to the display screen, the image information generated for said lines is shifted by the number of pixels equal to the offset value stored in the storage means. The shifted image is then rewritten in synchronization with refreshing of said screen for the appearance of smooth scrolling. In the preferred embodiment, if the rewriting of the offset value exceeds a predetermined value, the offset value is set to zero and image information shifted by a predetermined amount is generated for the display to be smooth-scrolled.

The system for accomplishing the above method comprises a storage means for storing an offset value for each display line, a register means in which said offset value is loaded, a shifting means in which image information for said each display line is loaded and which shifts said image information by pixel and a selecting means for receiving said offset value from said register means and for selectively outputting said image information shifted in said shifting means according to said received offset value. The shifting means may be, for example, a shift register means; while said selecting means may be a multiplexer means.

The foregoing and other objects, features and advantages of the invention will be apparent from the following more particular description of the invention as illustrated in the accompanying drawings.

DETAILED DESCRIPTION OF THE INVENTION

Figure 1:
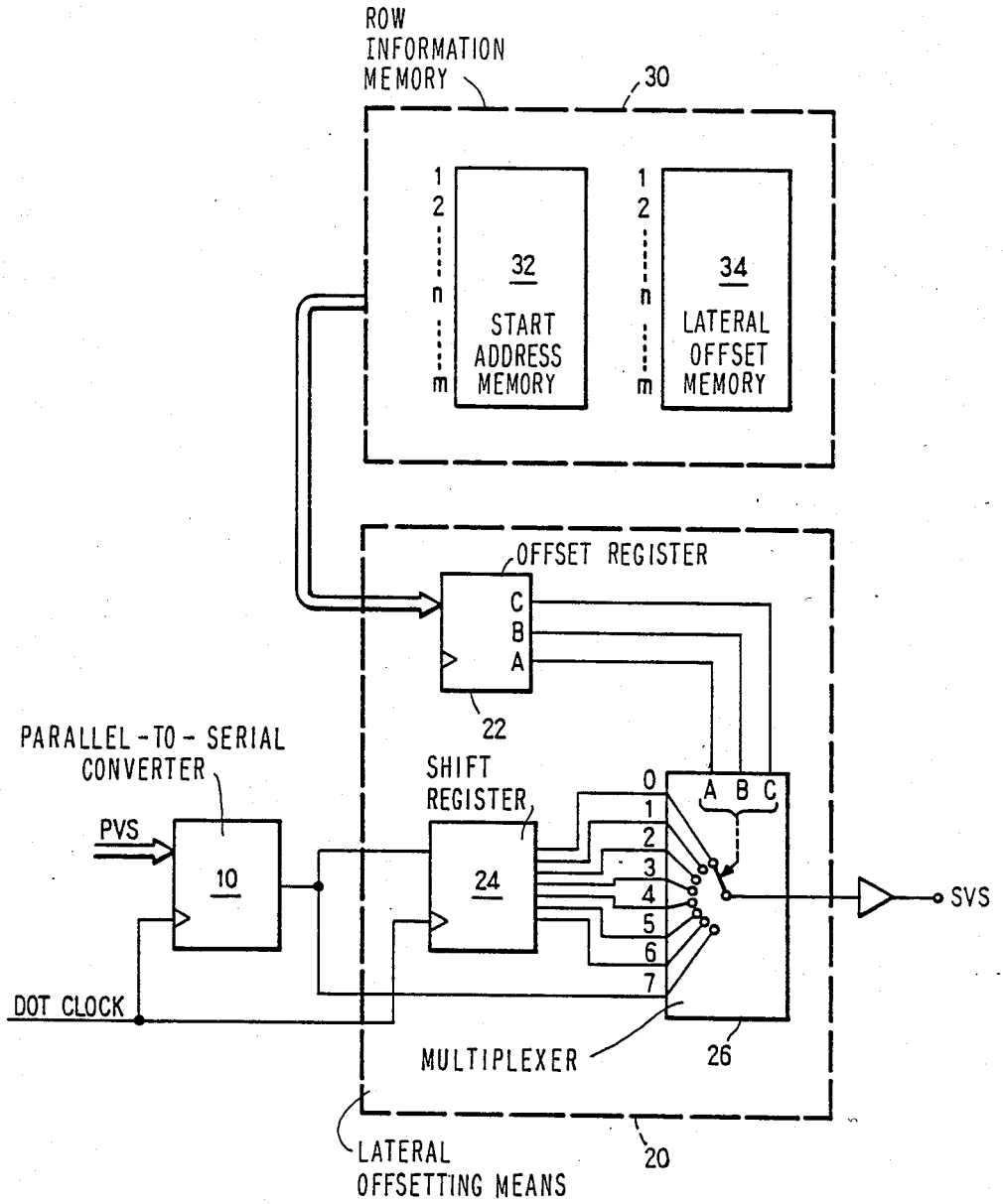
FIG. 1 shows a block diagram of an embodiment of the invention.

FIG. 1 shows a block diagram of the overall embodiment of the method and system for smooth scrolling according to the subject invention.

As can be seen in the FIGURE, and as known in the prior art, a typical parallel video signal (PVS) first enters a parallel to serial conversion means 10. Means 10 should be recognized by those skilled in the art as being any well known parallel to serial video signal converters.

From said means 10, the serial video signal enters into a lateral offsetting means 20 as defined by the dotted rectangle of the FIG. 1. The lateral offsetting means 20 comprises an offset register 22, a shift register 24 and a multiplexer 26. Further connected to said offset register means 22 is row information memory means 30 as also defined by a dotted rectangle in the FIG. 1. Row information memory means 30 comprises a start address memory 32 for storage of a start address of each row and a lateral offset memory 34 for storage of the offset values for each display row.

In operation, parallel video signals (PVS) that are generated by a character generator or image buffer, not shown, are converted into serial video signals (SVS) by parallel to serial conversion means 10. From said means 10, the serial video signals are then supplied to the shift register 24, wherein a dot clock assembles the parallel and serial video to the same time reference in both means 10 and shift register 24. The serial video signal from means 10 is also provided to offset value tap 7 of multiplexer 26.

Figure 2:
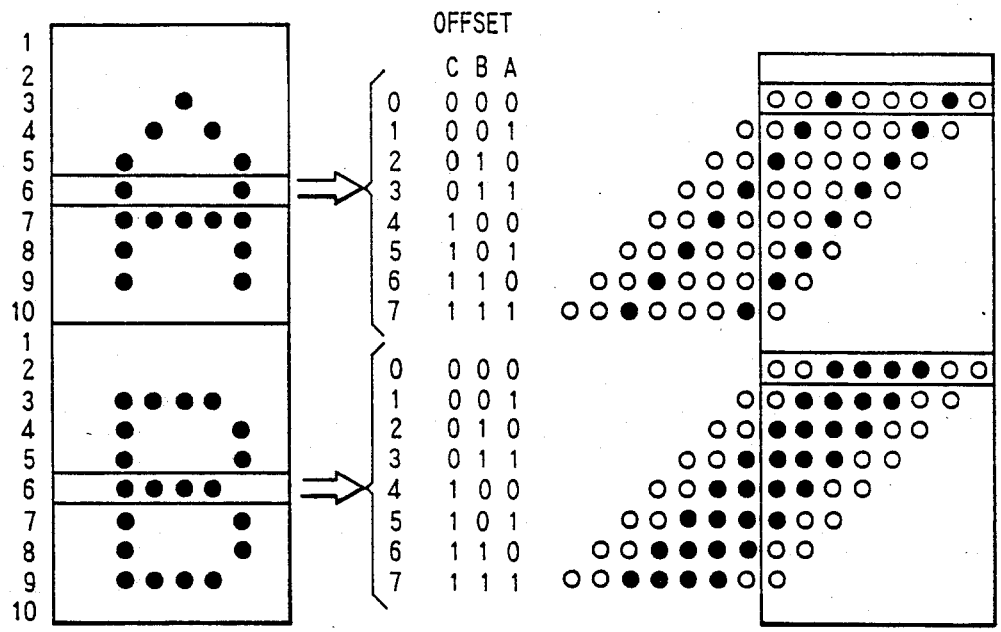
FIG. 2 shows a diagram illustrating output data of the shift register.

Next, depending on how many pixels each display row is to be laterally shifted, the lateral offset memory 34 of row information memory means 30 stores an offset value written by the software of the system (not shown). This offset value from memory 34 as well as the row start address of memory 32 are then transferred to the offset register 22 of the lateral offsetting means 20. Offset register 22, then, transfers the received offset value to multiplexer 26 which shifts the serial video signal from shift register 24, the number of pixels corresponding to the offset value. FIG. 2 shows an example of how this works.

In FIG. 2, serial video signals of the sixth scanning line of characters A and B, respectively, have been arranged to offset values 0 to 7 for input to the multiplexer 26 of FIG. 1. In FIG. 2, the characters A and B are shown displayed in character boxes of $8 \times 10$ pixel size. Following therefrom, the sixth scanning line of the characters A and B have each been indicated by the decimal and binary offset value of the shift. For example, a shift of 7 pixels is shown as equal to a binary value of: $C(2^2)=1$, $B(2^1)=1$ and $A(2^0)=1$. A, B, and C, represent the register values of the offset register means 22 of FIG. 1. Further shown in FIG. 2, is the graphic representation of the pixel displacement corresponding to the binary and decimal values. At the top of the block of the graphic representation is the display of the sixth scanning line with an offset value of 0. Proceeding in succession, therefrom, each of the seven scanning rows is shown laterally scrolled by increments of one pixel per line.

With the above configuration, smooth scrolling of individual lines can be obtained so that the display image is laterally shifted by a pixel for each individual display row. In addition, with this system, the image is made to move smoothly in the lateral direction without eye strain or fatigue as the offset value and display start address are refreshed in synchronization with the display screen.

Figure 3:
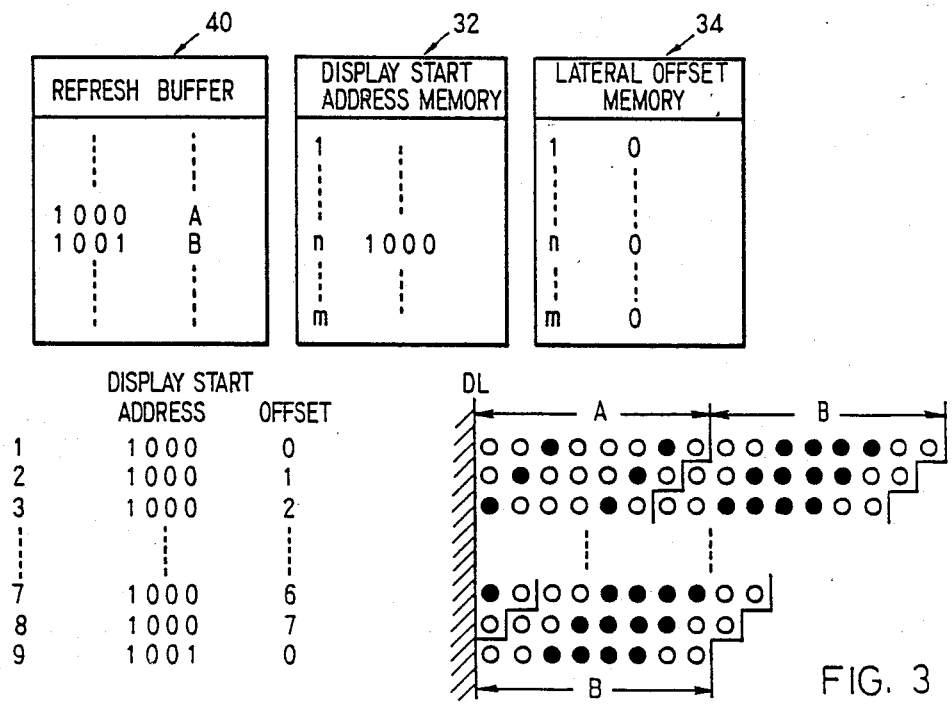
FIG. 3 shows a diagram illustrating operation of an embodiment of the invention.
Figure 4:
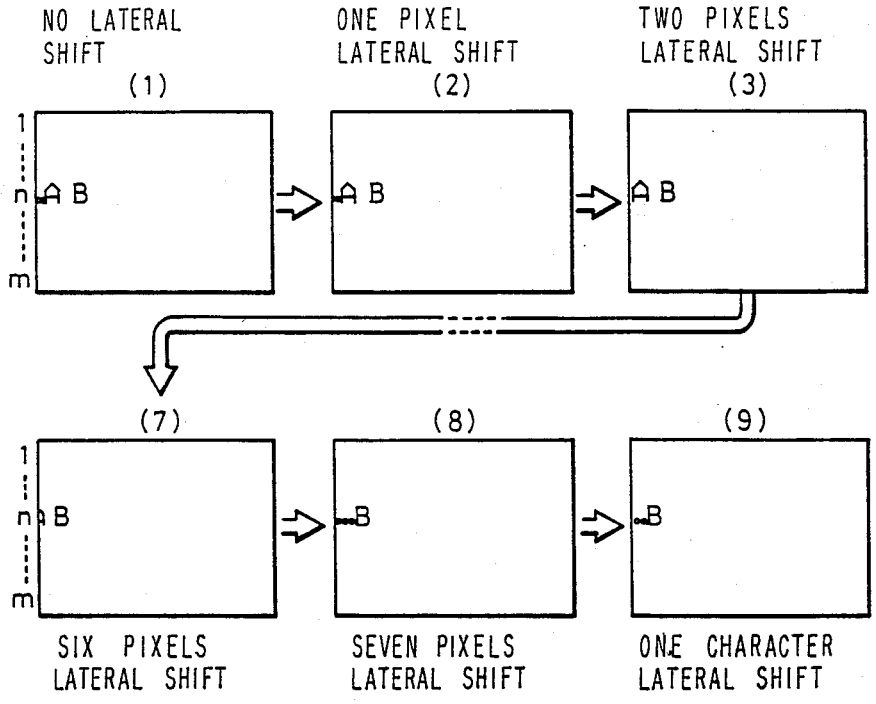
FIG. 4 shows a diagram illustrating smooth-scrolling of a displayed image on a display screen.

FIGS. 3 and 4 show an example of how the smooth scrolling system according to this invention works.

Referring now to FIG. 3, the display rows of a display screen are identified as running l through m. For a typical display row n, the characters "A,B, . . . " are displayed therein. From the FIG. 3, the display start address for row n is identified as 1000 from display start address memory 32 and the lateral offset for row n is 0 from the lateral offset memory 34. Screen refresh buffer 40 shows the character A of the $n^{th}$ row identified by address 1000 and character B of the same row identified by address 1001.

Based on the above character addresses, it should be readily recognized by one skilled in the art that for the $n^{th}$ row, character A coincides to the left end of a display screen DL so that characters "A,B, . . . " in the $n^{th}$ row are displayed in a state with no lateral shifting as shown in FIG. 4(1). This is also depicted graphically for the sixth scanning line of characters A and B in FIG. 3.

When scrolling is commanded from the screen control circuitry, the offset value in memory 34 is then set to 1 for the character row to be scrolled which in this case is the $n^{th}$ row. For the $n^{th}$ row the display start address, as stated above, is 1000. Now, however with an offset value of 1, the characters position relative to screen edge DL has changed.

As can be seen in FIG. 1, offset register 22 will now reset to the corresponding binary address for an offset value of 1 pixel. This has already been shown to be 001 from FIG. 2. Offset register 22 then triggers multiplexer 26 to refresh frame buffer 40 with a serial video signal which has been shifted by the dot clock from shift register 24 by one pixel. This is shown as an image in FIG. 4(2) and graphically for the sixth scanning row of characters A and B in FIG. 3.

The above sequence of events can then be repeated on command for scrolling as desired. (FIGS. 4(3)–4(9)). However, when the offset value reaches 7 with the display start address of 1000, as the character box is only 8 pixels wide, the display start address must be incremented to the next character address in that display row. Therefore, the display start address is set to 1001 with an offset value 0 to continue scrolling. The value 1001 is recognized from refresh buffer 40 (FIG. 3) as corresponding to the character B. The sequence, thus, is able to be repeated for each character of said display row.

Although the smooth-scrolling of the subject invention has been described for one display row, the lateral smooth-scrolling can be implemented in any screen number of configurations by controlling each display row with software. In addition, even if the display screen is constituted by a plurality of display areas, the smooth-scrolling can be performed independently for each display row in each display area by providing a plurality of offset memories and offset registers.

As described, the invention enables one to easily, independently, selectively and dynamically smooth-scroll a display image in each display line. Thus, it is possible to realize complicated and various image display by controlling the existence or nonexistence of smooth-scrolling or its speed.

Thus, while the invention has been described with reference to preferred embodiments thereof, it will be understood by those skilled in the art that various changes in form and details may be made without departing from the scope of the invention.

Having thus described our invention, what we claim as new, and desire to secure by Letters Patent is:

1. In a display system wherein a displayable image is comprised of pixel elements which pixel elements are arranged in horizontal and vertical rows such that the scrolling of said displayable image from the displayed screen requires a reconfiguration of the picture elements, the improvement to said display system for lateral scrolling of at least one horizontal pixel row comprising:

(a) a lateral offset storage means for storing a predetermined lateral offset value for each display line of a display screen, (b) an offset register means in which said lateral offset value is loaded from said lateral offset storage means, (c) a shift register means in which image information for said each line of pixels is loaded and which shifts said image information by said offset value; and (d) a multiplexer means for receiving said offset value from said offset register means and for selectively outputting said image information shifted in said shift register means according to said received offset value.

2. An apparatus according to claim 1 wherein when said offset value exceeds a predetermined value, the offset value is set to zero and the image information is shifted by a predetermined amount for said display line being scrolled.

3. A display system for displaying a plurality of lines of information, each line of information comprising one or more lines of pixels, said display system comprising:

means for producing a serial video signal, said serial video signal comprising a series of pixel-line signals, each pixel-line signal representing a line of pixels;

offset memory means for storing a plurality of lateral offset values, each offset value corresponding to one line of information; and lateral offsetting means for receiving the serial video signal and for receiving the offset values, said lateral offsetting means laterally shifting each pixel-line signal by a number of pixels equal to the offset value corresponding to the line of information comprising the line of pixels represented by the pixel-line signal to produce a shifted serial video signal.

4. A display system for displaying a plurality of lines of information, each line of information comprising one or more lines of pixels, said display system comprising:

means for producing a serial video signal, said serial video signal comprising a series of pixel-line signals, each pixel-line signal representing a line of pixels;

offset memory means for storing a plurality of lateral offset values, each offset value corresponding to one line of information; and lateral offsetting means for receiving the serial video signal and for receiving the offset values, said lateral offsetting means laterally shifting each pixel-line signal by a number of pixels equal to the offset value corresponding to the line of information comprising the line of pixels represented by the pixel-line signal to produce a shifted serial video signal;

characterized in that the lateral offsetting means comprises:

a shift register for receiving the serial video signal;

an offset register for receiving an offset value from the offset memory means; and a multiplexer for receiving the offset value from the offset register, said multiplexer receiving the serial video signal from the shift register and shifting each pixel-line signal by a number of pixels equal to the corresponding offset value to produce the shifted serial video signal.

5. A display system as claimed in claim 4, characterized in that:

each line of information comprises a plurality of characters, each character comprising a number of pixels;

the display further comprises start address memory means for storing a plurality of starting addresses, each starting address corresponding to one line of information, each starting address representing the first character to be displayed from the line of information; and the lateral offsetting means receives the starting addresses and shifts each line of information to start the line display with the first character for that line.

6. A display system as claimed in claim 5, characterized in that:

each character has a length of n pixels in each line of pixels; and the offset value is less than n.

7. A method of displaying a plurality of lines of information, each line of information comprising one or more lines of pixels, said method comprising the steps of:

producing a serial video signal, said serial video signal comprising a series of pixel-line signals, each pixel-line signal representing a line of pixels;

storing a plurality of lateral offset values, each offset value corresponding to one line of information; and laterally shifting each pixel-line signal by a number of pixels equal to the offset value corresponding to the line of information comprising the line of pixels represented by the pixel-line signal to produce a shifted serial video signal.

8. A display system as claimed in claim 6, further comprising:

means for incrementing the offset value corresponding to a first line of information; and means for incrementing the starting address corresponding to the first line of information and resetting the offset value corresponding to the first line of information after the offset value corresponding to the first line of information reaches a selected value.

* * * * *